US009863112B2

(12) United States Patent
Laugwitz

(10) Patent No.: US 9,863,112 B2
(45) Date of Patent: Jan. 9, 2018

(54) METHOD FOR SOIL COMPACTION WITH AN ATTACHABLE COMPACTOR, ATTACHABLE COMPACTOR AS WELL AS AN EXCAVATOR WITH AN ATTACHABLE COMPACTOR

(71) Applicant: BOMAG GmbH, Boppard (DE)

(72) Inventor: Niels Laugwitz, Lahnstein (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 15/461,696

(22) Filed: Mar. 17, 2017

(65) Prior Publication Data

US 2017/0268193 A1 Sep. 21, 2017

(30) Foreign Application Priority Data

Mar. 18, 2016 (DE) ..... 10 2016 003 387

(51) Int. Cl.

| | |
|---|---|
| ***E02D 3/00*** | (2006.01) |
| ***E02D 3/046*** | (2006.01) |
| ***E01C 19/38*** | (2006.01) |
| ***E01C 19/40*** | (2006.01) |
| ***E02F 3/96*** | (2006.01) |
| ***E02F 9/22*** | (2006.01) |
| ***E02F 9/26*** | (2006.01) |
| ***E02D 3/074*** | (2006.01) |

(52) U.S. Cl.

CPC ..... *E02D 3/046* (2013.01); *E01C 19/38* (2013.01); *E01C 19/40* (2013.01); *E02D 3/074* (2013.01); *E02F 3/967* (2013.01); *E02F 9/2271* (2013.01); *E02F 9/26* (2013.01)

(58) Field of Classification Search

CPC ..... E02D 3/046; E01C 19/38; E01C 19/40; E02F 3/967; E02F 9/26; E02F 9/2271

USPC ..... 404/133.2, 84.05–84.5, 72, 75, 113, 114, 404/117–120, 133.05

See application file for complete search history.

(56) References Cited

U.S. PATENT DOCUMENTS

| | | | | |
|---|---|---|---|---|
| 3,181,442 | A * | 5/1965 | Brigel | E01C 19/38 404/113 |
| 3,917,426 | A * | 11/1975 | Wohlwend | B06B 1/16 404/113 |
| 4,023,288 | A * | 5/1977 | Roe | E02D 3/032 172/464 |
| 4,103,554 | A * | 8/1978 | Thurner | E02D 3/046 404/133.05 |
| 4,224,003 | A * | 9/1980 | St. Louis | E02D 3/046 37/904 |
| 4,278,368 | A * | 7/1981 | Livesay | E02D 3/032 172/175 |

(Continued)

FOREIGN PATENT DOCUMENTS

| | | |
|---|---|---|
| DE | 202004015141 U1 | 1/2005 |
| DE | 102008006889 A1 | 4/2010 |
| DE | 102013200274 A1 | 7/2014 |

*Primary Examiner* — Raymond W Addie

(74) *Attorney, Agent, or Firm* — Wood Herron & Evans LLP

(57) ABSTRACT

A method for operating an attachable compactor, an attachable compactor as well as an excavator with an attachable compactor. For a corresponding efficient operation in accordance with the present invention, a display indicates the end of a time interval (required compaction time) that depends on a measured contact force or a parameter corresponding to the contact force.

16 Claims, 3 Drawing Sheets

(56) References Cited

U.S. PATENT DOCUMENTS

| | | | | | |
|---|---|---|---|---|---|
| 4,610,567 | A * | 9/1986 | Hosking | E01C 19/268 | 172/547 |
| 4,722,635 | A * | 2/1988 | Schnell | E02D 3/046 | 404/102 |
| 4,966,499 | A * | 10/1990 | St. Louis | E02D 3/02 | 37/904 |
| 5,070,947 | A * | 12/1991 | Scott | E02D 3/046 | 172/40 |
| 5,526,590 | A * | 6/1996 | Palm | E02D 3/026 | 172/40 |
| 8,602,680 | B2 * | 12/2013 | Fischer | E01C 19/288 | 404/133.05 |

* cited by examiner

METHOD FOR SOIL COMPACTION WITH AN ATTACHABLE COMPACTOR, ATTACHABLE COMPACTOR AS WELL AS AN EXCAVATOR WITH AN ATTACHABLE COMPACTOR

CROSS-REFERENCE TO RELATED APPLICATION

The present application claims priority under 35 U.S.C. §119 of German Patent Application No. 10 2016 003 387.8, filed Mar. 18, 2016, the disclosure of which is hereby incorporated herein by reference in its entirety.

FIELD OF THE INVENTION

The present invention relates to a method for soil compaction with an attachable compactor, an attachable compactor as well as an excavator with an attachable compactor.

BACKGROUND OF THE INVENTION

A so-called attachable compactor is a supplementary/attachable device for an excavator used, in particular, in trench and pipeline construction. Such attachable compactors are, for example, described in DE 10 2013 200 274 A1, DE 20 2004 015 141 U1 and DE 10 2008 006 889 A1. Generic attachable compactors generally comprise a base plate that can be vibrated by means of a vibration generator, usually an eccentric generator, a power unit for the vibration generator and a superstructure that is connected to the base plate via damping elements, the superstructure further comprising a coupling device for connecting an excavator arm. During operation, the operator of the excavator places the attachable compactor by means of the excavator arm at the position on the ground that is to be compacted. The attachable compactor is then pressed with its base plate onto the ground and the vibration generator is turned on. As a result, the vibratory motions generated are transmitted to the ground, whereby the ground is compacted.

The essential factor for the efficient operation of the attachable compactor is the amount of time the attachable compactor is pressed onto the respective point in the ground while in the vibrating mode. On the one hand, this process has to be maintained until a desired soil compaction is achieved. On the other hand, however, as of a certain point, the longer the attachable compactor is placed on the ground, the less the soil compaction progresses. This means that the compaction process becomes increasingly ineffective over time as of a certain point. This situation occurs, in particular, if the excavator does not press the attachable compactor down during the compacting operation. The progressively condensed ground then yields downwards, which renders the compaction process and, in particular, long compaction intervals even more inefficient.

It is known in the prior art, for example DE 20 2004 015 141 U1, to monitor the degree of compaction of the ground by means of an acceleration measurement of the base plate throughout the compacting process. However, this process is comparatively complex and also cost-intensive to implement. DE 10 2013 200 274 A1 also proposes a "compaction end detection." Specifically, this is to be displayed when no further or at least very unsubstantial further compaction of the soil takes place during the operation of the attachable compactor. For this purpose, the progressing soil compaction is tracked by a sensor during the work process.

SUMMARY OF THE INVENTION

It is an object of the present invention to provide a simple way of rendering soil compaction more efficient by means of an attachable compactor without particularly having to monitor the course of the soil compaction by means of sensors.

One aspect of the present invention lies in the realization that the continuous detection and monitoring of the current soil compaction is not necessary in order to achieve satisfactory soil compaction results. Rather, sufficient soil compaction results can already be obtained after certain time intervals during which the attachable compactor compacts the ground. The main factor influencing the compaction operation is, in particular, the contact force with which the attachable compactor is pressed against the ground surface during the compaction process by the excavator. In the following explanations, the force component of the contact force extending in the vertical direction is particularly relevant. In the case of an attachable compactor that is connected to an excavator arm, pressing usually occurs by means of the excavator arm. The greater the force used to press the attachable compactor against the ground surface by means of the excavator arm at the beginning of the compaction process, the shorter the working interval required to achieve sufficient soil compaction. Soil compaction beyond this working interval is inefficient, as the achievable increase in ground compaction is minimal and disproportionate to the work effort invested, in particular in terms of time. The determination of the working interval as a function of the contact force can, in particular, be determined empirically by means of laboratory and/or field tests. According to the present invention, it is thus not envisaged that the soil compaction is determined in the course of the compaction process in progress. The period of time the attachable compactor is pressed against the ground surface during each compacting interval is rather determined in a simplified manner as a function of the contact pressure force. After the expiry of a set compaction interval, the method according to the present invention thus assumes that sufficient soil compaction has occurred and that a continuation of the current compaction interval is no longer efficient. As a result, the operation of the attachable compactor can be carried out considerably more efficiently with a comparatively simple design, as the operator of the attachable compactor is in possession of a simple and clear guideline regarding how long the different compaction steps need to be effectively carried out.

Specifically, the method for soil compaction according to the present invention by means of an attachable compactor thus comprises the steps: A) pressing the attachable compactor against the ground to be compacted by means of a bearing device, B) measuring the contact force exerted on the attachable compactor by means of the bearing device or a measured variable correlating with the contact force, C) determining a required compaction time as a function of the measured contact force or the measured variable correlating with the contact force, and D) actuating a signaling device at least at the end of the required compaction time. During operation, the attachable compactor is usually pressed on the ground from above by means of the excavator arm, which is connected to the attachable compactor via the bearing device. This can be done, for example, by means of known hydraulic actuating devices for moving the excavator arm. According to the present invention, the contact force exerted by the bearing device on the attachable compactor is determined. This can be achieved by means of a direct force measurement or by determining a measured variable correlating with the contact force, such as the hydraulic pressure, the contact force of the attachable compactor, the voltage and/or deformation signals generated via a sensor, etc. Essential here is that it is possible to determine whether the attachable compactor is pressed onto the ground with a relatively large or a relatively small contact force. Particularly, relevant here is the contact force extending in the vertical direction or the vertical portion of the contact force on the attachable compactor. The greater the contact force, the shorter the required compaction time required to achieve a desired soil compaction. In this case, the "required compaction time" indicates a time interval within which an efficient compaction of the soil occurs based on, e.g., empirical investigations. As a rule, the "required compaction time" does not lead to the theoretically maximum soil compaction. The "required compaction time" is rather preferably set in such a manner that soil compaction processes occur to a significant and practically relevant extent within this time interval. On the one hand, this ensures that satisfactory compaction results are obtained within the time frame of the "required compaction period", while avoiding an uneconomical, excessively long soil compaction. The extent of the "compaction time" required for the case at hand can vary in different cases and, for example, be set by the user by the specification of a desired minimum degree of soil compaction. In practice, the so-called proctor density according to DIN 18127 can be used here. Therefore, if the applied contact force or the measured variable correlating with the contact force is determined, the compaction time required for the applied contact force or the measured variable correlating with the contact force is determined by recourse to known references that are, e.g., stored in a memory unit. The actuation of a signal device at least at the end of the required compaction time is also essential for the method according to one embodiment of the present invention. This signals to the operator if it is preferable to abort the current compaction process and, e.g., start a new compaction process at a different location or reapply the ground compactor. The operator of the attachable compactor thus has a simple and efficient way of optimizing the operation of the attachable compactor so that the individual compaction intervals are sufficiently long, but not too long. For this purpose, it is primarily important that the end of the reasonable compaction period be signaled to the operator in some form. This is described in more detail below.

It is preferable if essential steps are coordinated by a common control unit for carrying out the method according to one embodiment of the present invention. Specifically, the contact force measured in the above-mentioned step B) or the measured variable correlating with the contact force is relayed to this control unit. The control unit thus initially receives the decisive information for the selection of the required compaction time. Furthermore, it is also preferable if steps C) and/or D) are also controlled by the control unit. The control unit thus preferably represents the central interface, on the one hand, for processing the relevant information "contact force" or "measured variable correlating with the contact force" and, on the other hand, for determining and defining the "required compaction time" as well as for actuating the signaling device. According to one embodiment of the present invention, the control unit is ideally arranged on the attachable compactor in order to enable a central and independent (vis-à-vis the excavator) execution of the method according to the present invention.

The specific determination of the required compaction time can also take place in different ways. For example, in the simplest scenario, the ascertained contact force or the variable correlating with the contact force can be multiplied by a set factor. With regard to the compaction result, however, better results can be obtained if, in step C), a comparison of the measured contact force or the variable correlating with the contact force with a value table, an index field or a plurality of reference curves stored in a memory unit occurs. The value table is, e.g., subdivided into the values "contact force" and "required compaction time" so that, in the case of a known contact force, only the corresponding required compaction time has to be assigned. A possible index field, for example, indicates the progress of the obtained soil compaction, e.g., the Proctor density, as a function of the contact force in relation to the compaction duration. Using an index field has the advantage that smaller variations in the desired soil compaction are possible. As an alternative to an index field, a large number of reference curves can also be used, which indicate the progress of soil compaction, in particular the progress of the proctor density, as a function of the compaction time. The value table or the index field or the plurality of reference curves stored in the memory unit can either be preset by the user or are preferably stored in the memory unit when manufactured. The data required for this purpose is based, in particular, on empirical laboratory and/or field tests.

The required compaction time represents an individual value with regard to the desired compaction result. Essential here initially is that, with a constant energy input into the soil, the compaction of the soil increases logarithmically with the number of load changes. If, for example, it is assumed that a theoretically maximum soil compaction is equated with 100%, the "required compaction time" preferably corresponds to an interval during which at least 70%, in particular at least 80%, and especially at least 85% of the maximum possible soil compaction is achieved with the measured contact force or with the variable correlating with the contact force. However, since a theoretically maximum soil compaction cannot be achieved naturally, it has proven expedient to refer to analogous parameters when determining the required compaction time in question. A preferred possibility is, for example, an indication of the soil compaction by means of a degree of compaction Dpr [%] (hereinafter also referred to as compaction degree Q). This percentage degree of compaction describes the bulk density in comparison to the standardized Proctor test according to DIN 18127, which is hereby incorporated by reference. The purpose of the experiment is to assess the density that can be achieved at construction sites and to verify the performance of compaction work. The Proctor test is used to determine the water level at which the soil can be optimally compacted at constant compaction energy. The corresponding index values are the Proctor density and the optimum water content. The degree of compaction is the quotient of the dry density of the soil and of the Proctor density determined in the laboratory. It is essential that a reference ground sample is filled into a container during the Proctor test and compacted with defined work by a drop weight over a certain number of compaction strokes. The resulting dry densities are represented as a so-called Proctor curve in relation to the water content, and the maximum density and optimum water content are determined. The compaction time required according to the present invention is therefore also preferably determined in such a way that it corresponds to the time interval during which a degree of compaction (Proctor density) of 95%, in particular 98% and especially 100%, is achieved.

The compaction process is executed most rapidly when a high pressure is applied. However, a high contact force cannot always be realized, since the damping elements between the base plate and the superstructure of the attachable compactor are only designed for a certain maximum load. An attempt to further increase the contact force beyond the maximum load may result in protective elements such as overload stops coming into operation, whereby the vibration-damping effect of the damping elements is greatly reduced. On the other hand, in the event of a large distance between the compactor and the excavator, merely a reduced contact force can be exerted, as the compactor is only supported by the weight of the excavator. The optimal positioning of the excavator in relation to the attachable compactor is not always possible as, for example, spatial conditions on the construction site may not allow it. The long lever arm of an extended excavator arm can also significantly reduce the possible contact force depending on the geometry of the excavator arm. Due to the continuous pressing and compaction of the soil, the excavator arm must also frequently be continuously adjusted in order to maintain the desired high contact pressure. From the foregoing, it is clear that it is only rarely possible in practice to apply the maximum contact pressure constantly during each compaction process. It is also difficult for the machine operator to estimate the different high contact pressure forces and particularly difficult for the operator to correctly estimate their influence on compaction efficiency. It is thus helpful when the actual effective contact force is measured directly or indirectly and its influence on the compaction is signaled. In this way, an unnecessarily long compaction can be avoided with advantageous high contact forces or, if the contact force is reduced, the longer compaction time then required is indicated.

With respect to step D), alternative possibilities are also conceivable and preferred, which can also be combined with one another. During operation or during the execution of the method according to the present invention, it is convenient if the operator can estimate approximately how long the compaction step in question will take. It is thus preferable if the signal device not only indicates the progress of the required compaction time, but also allows an optical countdown corresponding to the required compaction time. Such an optical countdown can, for example, be implemented in a plurality of lamps arranged side by side in a row, which turn on or off in succession. Such a visual countdown can, in particular, also consist in displaying a remaining time interval corresponding to the total remaining time required for total compaction. In this case, the actual time runs down from the determined required compaction time to zero by means of a numerical display. In addition or alternatively, only one signal light is illuminated or alternatively switched off at the end of the required compaction time. However, it is better to display a traffic light function depending on the required compaction time. This traffic light function can, for example, be configured in such a way that, as long as the compaction process is to be maintained, a green light is illuminated, and when the compaction time has expired, the green light goes out and a red light is illuminated. Additionally, or alternatively, the end of the compaction period can be signaled by the emission of an acoustic signal as soon as the required compaction time has expired. Such a signal may be, for example, a horn tone or something similar. It is additionally, or alternatively, also possible that the signaling of the end of the compaction time directly affects the control of the attachable compactor. In particular, this can be done, for example, by stopping a vibration function of the attachable compactor, which is preferably triggered by the control unit. If the attachable compactor is switched off, the operator knows that the required compaction time has elapsed. Additionally, or alternatively, the display of the currently required compaction time/compaction speed corresponding to the contact force is affected by a light-emitting element that flashes with a higher or lower frequency. It can also be provided that the flashing frequency increases as the expiration of the fixed time interval approaches and a continuous display (i.e. without flashing) occurs at the end of the fixed time interval.

In order to carry out the method according to the present invention in a particularly efficient manner, a reset function is preferably provided in such a way that steps A) to D) are automatically executed in the same order when the attachable compactor is reset on the ground, which can be detected, for example, by an increase in the contact force or a corresponding value. The reset function thus ensures that the steps A) to D) run cyclically without the operator having to initiate them each time manually, in particular, the measurement, determination and actuation of the signal device according to steps B) to D). The trigger in this case is rather preferably either the reduction of pressure exerted on the attachable compactor and/or the detection of a new pressing operation.

In principle, the direct determination of the specific contact force does not have to occur in order to carry out the method according to the present invention. Corresponding measurement values can also be used here. It is initially essential that it is possible to make a statement about whether the attachable compactor is pressed with a large force or with a small contact force onto the ground. An alternative measurement value that corresponds to the contact force can thus be, for example, the hydraulic pressure of an actuating cylinder of the excavator arm. The greater the hydraulic pressure within the actuating cylinder, the more the attachable compactor is forced onto the ground. In principle, suitable electrical voltage signals of a sensor element can also be used that correlate with the contact pressure force. In addition, or alternatively, the contact force can also be calculated from the pressure of one or more hydraulic cylinders of the excavator arm if the position of the excavator arm is known. It is also possible to resort to the measurement of a relief pressure or a relief force on at least one driving device of the excavator. The more the attachable compactor is pushed against the ground, the stronger or weaker is the stress on one of the at least two general driving devices. This can vary with the rotational position when using a rotatable excavator superstructure and this is taken into account in this alternative for determining the required compaction time. Additionally, or alternatively, a path signal can also be used on an elastic connecting element between a base plate and a superstructure of the attachable compactor. The superstructure of the attachable compactor is usually connected via elastic damping elements to the base plate of the attachable compactor, which is in contact with the ground. The stronger the attachable compactor is pushed onto the ground, the higher the load on the elastic connecting element. As a result, the deformation of the elastic connecting element also correlates with the contact force and can thus be used as reference value for determining the required compaction time. In addition, the contact force of the ground compactor on the ground can also be used as a force correlating to the contact force. In principle, strain measurements of components located in the force flow can also be carried out, for example, via strain gauges or strain transducers in a known manner. A determination of the strain or compaction is also possible in the force bypass, since the precision required here is not very high.

Another feature of the present invention lies in an attachable compactor, in particular, for carrying out the method according to the present invention. A generic attachable compactor includes a base plate, a motor-driven vibration generator with which the base plate can be vibrated, a superstructure connected to the floor plate, and a coupling device that is configured for the coupling of an excavator arm. The motor-driven vibration generator can, for example, be an eccentric device for generating the desired vibrations. The motor drive of the vibration generator can be realized by means of a hydraulic motor fed by the hydraulic system of the excavator or by an alternative motor. Essential for the present invention here according to one embodiment is that first a sensor device is provided that makes it possible to determine a contact force of the excavator arm on the attachable compactor or a variable correlating with the contact force. The latter can, for example, also be the contact pressure of the attachable compactor on the ground or a variable correlated with this contact force. With respect to the contact pressure force or the variable correlating with the contact force, reference is made to the above description regarding the method according to the present invention. Furthermore, in accordance with one embodiment of the present invention a control unit is provided that determines a required compaction time on the basis of the determined contact force or on the basis of the variable correlating with the contact force. Moreover, a signaling device is provided that is configured for displaying at least the expiry of the required compaction time. With respect to the actual configuration and operation of the control unit, the calculation and determination of the required compaction time as well as the mode of operation of the signal device, reference is made here to the explanations above. It is preferable to arrange all of the foregoing elements as a closed system on the attachable compactor. This enables, in particular, the use of the method according to the present invention independently of the design of the excavator connected to the attachable compactor in the working process.

A plurality of alternatives can be employed in the specific embodiment of the sensor device. It is preferred that the sensor device comprises of at least one sensor element in the form of a force sensor, in particular a resistive force sensor, a piezo force transducer or a strain gauge. Such sensors are characterized by their high functional reliability and low susceptibility to malfunctions or failures. The immediate determination of the contact force can be achieved through the use of a sensor element configured as a force sensor. Additionally, or alternatively, it is also possible to use displacement sensors, preferably non-contact, that determine deformation phenomena by way of inductive, capacitive, optical or ultrasonic measuring principles. The use of (linear) potentiometers is also possible. It is also preferable that the sensor device is arranged on the superstructure. This way, the sensor device is only exposed to the vibrations occurring during the compaction process to a lessened extent because of the dampers. Ideally, the sensor device should be at least partially integrated directly in the coupling device, particularly in the attachable compactor. If the coupling counterpart of the excavator engages the coupling device of the attachable compactor, it is preferable to create a direct physical contact with the excavator arm, through which it is possible to determine the contact force or a variable correlating with the contact force. Frequently, the coupling device also has protective devices against dirt or other contamination phenomena, by means of which it is also possible to protect the sensor device at the same time. In order to enable a transmission of the measurement signals determined by the sensor device to the control unit, the sensor device should preferably be connected to the control unit via a signal line. This can be done via a corresponding cable, but also in a wireless manner. Finally, the sensor device can be configured so that it detects the deformation of an elastic damping element between the superstructure and the base plate. This can be effected, for example, by means of a distance-measuring sensor or comparable devices.

Preferably, the control unit is arranged on the superstructure of the attachable compactor. This also reduces the vibration stress on the control unit during operation of the attachable compactor. In this case, it is also preferred if the control unit or at least one interface of the control unit is arranged to be externally accessible on the attachable compactor, if appropriate through an adjustable protective device, for example a flap, and is shielded from the outside. This way, access to the control unit is made possible, e.g., for programming purposes for defining a specific ground type, etc. Additionally, or alternatively, it is also possible to store operating documentation in the control unit and to access it from the outside through this point.

The control unit ideally includes a memory unit. The memory unit serves to store a value table, an index field or a plurality of reference curves which contain the degree of compaction achieved or a corresponding value regarding the contact force or a corresponding value depending on the compaction time. Thus, the values relevant for determining the required compaction time can be stored directly in the control unit. The memory unit can also be used for documenting operations in order, for example, to record information regarding the duration of the operation, the working steps, etc., which can be read out later for control purposes.

The attachable compactor includes a signal device for the method according to one embodiment of the present invention. This is configured, for example, as a mobile part controlled by the control unit or is structurally arranged on the attachable compactor. The signal device signals the end of the required compaction time to the operator. For this purpose, the signal device also includes, for example, an optical display device, more specifically a display light, a display traffic light or a numerical display. By means of only a single indicator light, the end of the required compaction time can be indicated, e.g., by extinguishing or illuminating the indicator light when the required compaction time has elapsed. A traffic light can indicate the end of the required compaction time through a change in the display, preferably in different colors. A time display can be configured as a light bar or as a numerical display. Additionally, or alternatively, the signaling device can include an acoustic indicating device that acoustically signals that the end of the required compaction time has been reached, e.g., by means of the output of a speech and/or sound signal. For this purpose, the acoustic display device preferably includes a loudspeaker. It is also ideal if there exists a possibility to regulate the volume of the output of the acoustic display signal.

The signaling device is preferably arranged on the superstructure of the attachable compactor as the vibration stress is lower there. Preferred locations are either the upper side or at least the orientation towards the inner side of the attachable compactor. The inside of the attachable compactor refers to the outer wall that faces the excavator when it is mounted on an excavator arm.

The present invention also encompasses a supplementary and/or alternative configuration of the signal device which comprises a control element controlled by the control unit, with which the vibration operation of the vibration generator can be interrupted. The signal device can thus intervene in the working mode of the attachable compactor via the control element. If the required compaction time has elapsed, the control unit signals to the control element to switch off the vibration operation of the vibration generator. This ensures that operation of the attachable compactor beyond the end of the required compaction time is avoided.

Electrical energy is usually required to operate the attachable compactor according to the present invention. To this end, for example, the attachable compactor can be connected to the electrical system of an excavator. Additionally, or alternatively, a converter for converting vibrations into electrical energy can preferably be used in order to obtain electrical energy and the sensor device and/or the control unit and/or the signal device are supplied with the electrical energy obtained. Such converters, known as "energy harvesters", for converting vibrations in electrical energy have the advantage that they do not take up much space and also contribute to an increase in efficiency of the attachable compactor according to the present invention.

A further feature of the present invention lies finally in an excavator, comprising a drive motor, an operating platform, driving devices, an excavator arm and a coupling device connected to the excavator arm, with a base plate and a superstructure. The excavator is configured according to the present invention for carrying out the method according to the present invention.

In this case, the signal device provided for carrying out the method according to the present invention can also be arranged in the operating platform of the excavator. It goes without saying that the control unit maintains a corresponding signal line to the signal device, in particular in a wireless fashion. The arrangement of the signal device in the driver's cab of the excavator has the advantage that it is comfortable for the operator. Furthermore, it is ensured that the operator can see the progress of the required compaction time even when the attachable compactor is outside the operator's field of view.

Preferably, an electrical connection line is provided, which supplies the sensor device and/or the control unit and/or the signal device of the attachable compactor with electrical energy from the electrical system of the excavator. For the specific configuration of the sensor device, the control unit and the signal device, references are made to the foregoing description.

It is ideal if the attachable compactor is an attachable compactor according to the present invention as described above.

BRIEF DESCRIPTION OF THE DRAWINGS

The present invention is described in more detail below with reference to an exemplary embodiment shown in the figures. Depicted schematically are.

Identical components are assigned the same reference numbers in the figures, but not every component repeated in the figures is necessarily indicated each time with a reference number.

DETAILED DESCRIPTION OF THE INVENTION

Figure 1:
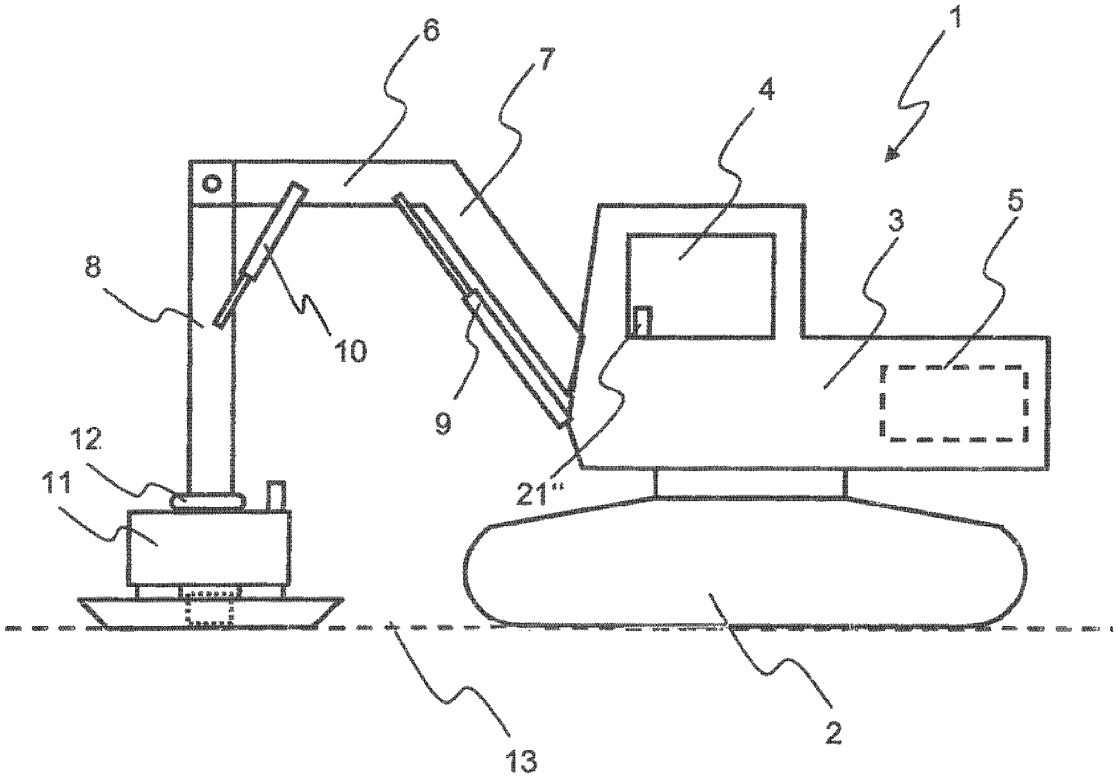
FIG. 1 is a side view of an excavator with an attachable compactor.

Essential elements of the excavator 1 are: a driving part (2) with driving devices, a machine part (3) which is rotatably mounted on the driving part and has an operating platform (4) and a drive motor (5) and an excavator arm (6). In the example shown here, the excavator arm 6 is of a two-part configuration, comprising an inner first excavator arm 7 and an external excavator arm 8. Excavator arms 7 and 8 can be actuated via hydraulic cylinders, 9 and 10. At the end of the second excavator arm 8, which extends essentially in the vertical direction, an attachable compactor 11 is connected to the excavator arm 6 by means of a coupling device 12. During the compaction operation, the attachable compactor 11 is pressed onto the ground surface 13 by means of the hydraulic cylinders 9 and 10 via the excavator arm 6. Further details of essential elements of the attachable compactor 11 can be seen in FIG. 2.

Figure 2:
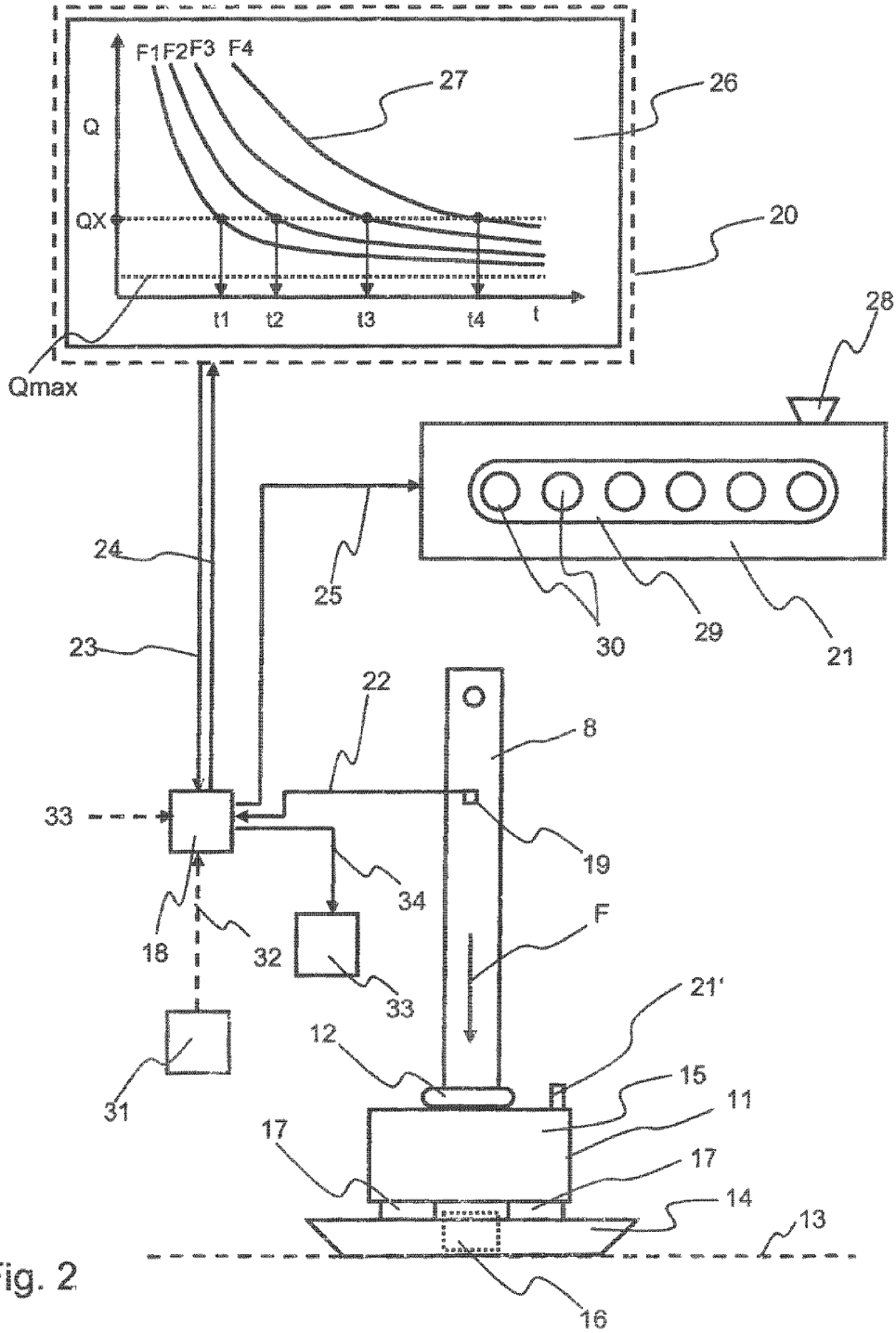
FIG. 2 is a view of a functional scheme of the attachable compactor from FIG. 1.

FIG. 2 shows the second excavator arm 8 from FIG. 1 with the attachable compactor 11 attached. Essential elements of the attachable compactor 11 are: a base plate 14, a superstructure 15, a motor-driven vibration generator 16, and a coupling device 12. The base plate 14 rests on the ground 13 on its underside. The base plate 14 is connected to the superstructure 15 by means of the damping elements 17. The coupling device 12 is arranged on the upper side of the superstructure 15 facing the excavator arm 6. The vibration generator 16 arranged on the base plate 14, in particular an eccentric vibration generator, vibrates the base plate 14, in particular in a vertical manner, during the compaction operation. The vibration generator 16 can, for example, be driven by means of a hydraulic motor of the attachable compactor 11, which is connected to the hydraulic system of the excavator 1 (not shown in the figures).

In order to render the operation of the attachable compactor 11 more efficient, a control unit 18, a sensor device 19, a memory unit 20 and a signal device 21 are also provided. These components can all be arranged on the attachable compactor 11. Additionally, or alternatively, however, it is also possible to place at least parts of the sensor device 19 and/or signal device 21 elsewhere. For example, the signal device 21 can be configured as a mobile part in the form of a mobile terminal, arranged in the operating platform 4. The arrangement of the sensor device 19 can also vary and, e.g., be integrated in the coupling device 12.

The sensor device 19 comprises, at least, one sensor element, with which the contact force F exerted on the attachable compactor 11 by the excavator arm 6, or a corresponding value, can be measured. The sensor device 19 is connected to the control unit 18 via a signal line 22. Signal lines 23 and 24 are also provided, which connect the control unit to a memory unit 20. Finally, a further connecting line 25 from the control unit 18 is provided to the signal device 21.

In the example shown, an index field 26 is stored in the memory unit 20. The index field 26 indicates the densities versus the degree of compaction D. In this case, the curves 27 represent the compaction progress for different contact forces or contact forces F1, F2, F3 and F4. F1 indicates the largest contact pressure force and F4 the lowest contact pressure force in the index field 26. Line Dmax indicates the position of the maximum soil compaction (theoretically). The index field 26 makes it clear that, as the contact pressure increases, the soil is compacted more quickly. The index field 26 makes it clear that the compaction curves approach asymptotically the theoretically maximum soil compaction.

This means that as the compaction progresses, the increase in soil compaction D steadily decreases.

In the present exemplary embodiment, a degree of compaction DX is desired. As a function of the exerted contact force F and taking the index field 26 into account, a required compaction time t1 to t4 results for each individual curve. If the sensor device 19, e.g., measures a contact force F2, the control unit 18 determines, using the index field 26, that the required compaction time requires the time interval t2. Alternatively to a desired (empirical) degree of compaction, the progress of an "efficient" compaction can also be decisive for the required compaction time in question. The compaction time required for the contact force exerted can be determined, for example, by a gradient limit value of the compaction curve. This ensures that an effective soil compaction is always carried out within a time frame.

If the compaction process begins, for example, by turning on the vibration generator 16, the control unit signals, via the signal device 21, the progress of the currently required compaction time t2. To this end, the control unit controls the signal device 21 via the connecting line 25 and triggers the emission of an acoustic signal, e.g., via the loudspeaker 28. Additionally, or alternatively, the signal device 21 can also have an optical signal device 29. For this purpose, a plurality of signal lamps 30 are arranged next to one another within a bar. At the beginning of the compaction process, all of the signal lamps 30 illuminate and the number of illuminated signal lamps 30 decrease evenly over the required compaction time t. When all signal lamps 30 have been extinguished, the operator knows that the required compaction time t2 has expired. Additionally, or alternatively, a numerical display and/or a multi-colored traffic light display, etc., can also be used.

Furthermore, a converter 31 for converting vibrations into electric energy is provided, which supplies the control unit 18 with electrical energy. The converter 31 is arranged on the base plate 14 and is connected to the control unit 18 via a connecting line 32. Alternatively, a connecting line 33 can be provided via which an electrical connection is made to an on-board electrical system of the excavator 1.

FIG. 2 illustrates a specifically preferred location of the signaling device 21 on the attachable compactor 11. The signal device 21 arrangement on the upper side of the attachable compactor 11 is indicated by the reference number 21'. Additionally, or alternatively, the arrangement of a mobile signaling device 21" can also be provided within the operating platform 4, as indicated in FIG. 1. The signal device 21" is connected to the control unit 18 via a cable-free signal line.

Additionally, or alternatively, the control unit 18 can drive a motor control unit 33 of the vibration generator 16 via a connecting line 34. This makes it possible to terminate the required compaction time t by stopping the vibrations generated by the vibration generator 16.

Figure 3:
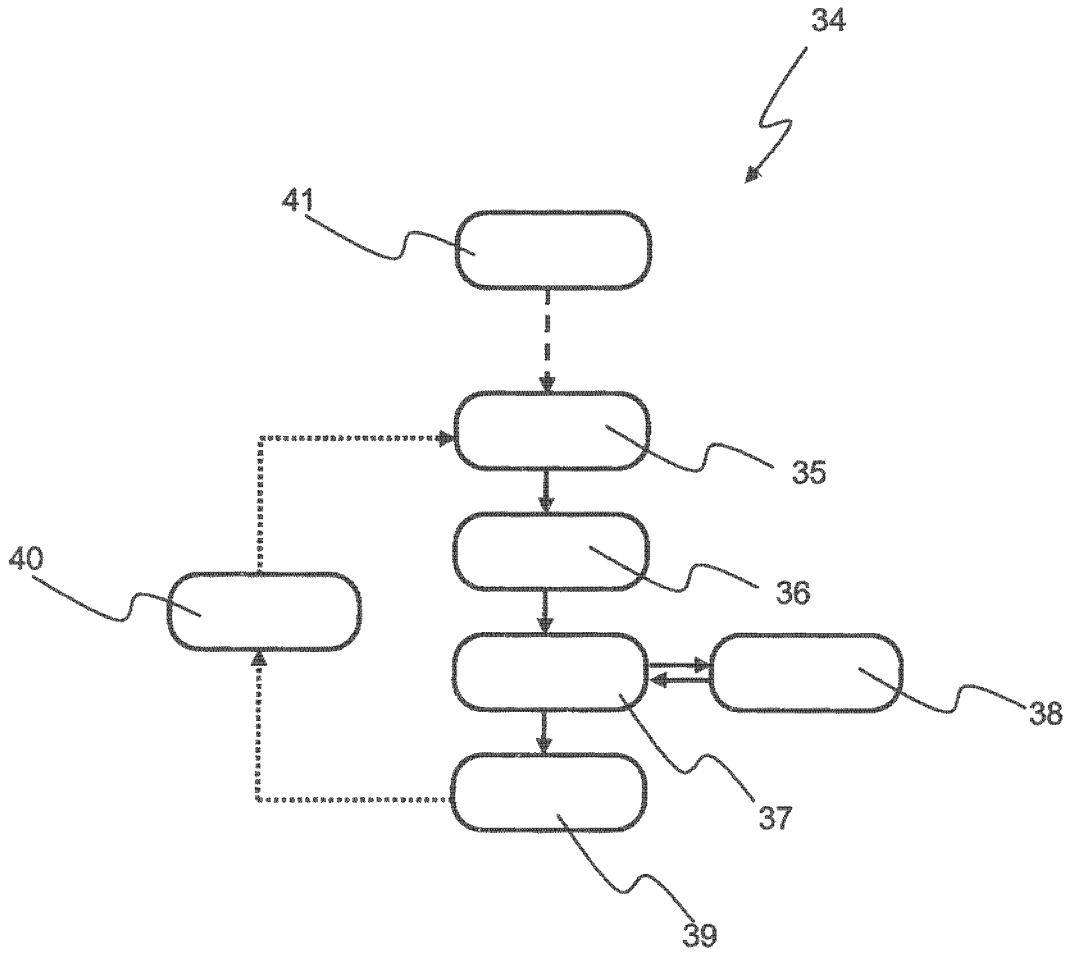
FIG. 3 is a flowchart of a method according to the present invention.

FIG. 3 illustrates the essential steps of method 34 according to one embodiment of the present invention for soil compaction by means of an attachable compactor, in particular of the attachable compactor 11 shown in the preceding FIGS. 1 and 2. In step 35, an initial action of the compacting operation is carried out by pressing the attachable compactor 11 onto the ground 13 to be compacted by means of a bearing device, in particular by means of an excavator arm 6 connected to attachable compactor 11 via the coupling device 12. In accordance with step 36, the contact force F exerted on the attachable compactor 11 by the bearing device 12 or the excavator arm 6 or a measured variable correlating with the contact force F is then measured. This occurs using a suitable sensor device 19, e.g., such as the sensor device specified in more detail in FIG. 2. The required compaction time t now results from the measured contact force F or a measured variable correlating with the contact force F in a next step 37. Specifically, e.g., this can take place in step 38 by comparing the measured contact force or the measured variable correlating with the contact pressure with a value table saved in a memory unit, an index field 26 or a plurality of reference curves. If a specific compaction time t is determined for the case at hand, the compaction process is continued until the required compaction time t has expired. Thereafter, at least in step 39, an actuation of the signal device 21 occurs so that the operator of the compactor 11 is made aware of the end of the required compaction time t.

In step 40, FIG. 3 also illustrates another option for the method according to the present invention. Here, steps 35-39 are designed to run cyclically. Here, for a restart starting with step 35, the required event is the canceling of the contact pressure and/or the lifting of the attachable compactor 11 from the ground 13 and/or the re-setting of the attachable compactor on the ground. The obtained reset function allows a particularly simple operation because the entire system starts again as of step 35 when the attachable compactor 11 is lifted or reset and pressed against the ground. An additional manual input is not required here. The re-pressing can be reliably detected, for example, by exceeding a determined contact pressure threshold value.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A method for compacting soil with an attachable compactor, comprising the steps of:

A) pressing the attachable compactor on the ground to be compacted via a bearing device;

B) measuring the contact force (F) exerted on the compactor by via the bearing device or a measured variable correlating with the contact force (F) exerted;

C) determining a required compaction time (t) depending on the measured contact force (F) or the measured variable correlating with the contact force (F); and D) actuating a signaling device at least at the end of the required compaction time (t).

2. The method according to claim 1, wherein the contact force (F) measured in step B) or the corresponding measurement value is relayed to a control unit, and that steps C) and/or D) can be controlled by said control unit.

3. The method according to claim 1, wherein in step C) a comparison of the measured contact force (F) or the corresponding measurement value of the contact force (F) with a value table, an index field or a plurality of reference curves stored in a memory unit occurs.

4. The method according to claim 1, wherein in step C) the required compaction time (t) corresponds to the time period in which a degree of compaction 95% Proctor density, in particular of 98%

Proctor density, and especially of 100% Proctor density is achieved with the measured contact force (F) or with the corresponding measurement value of the contact force (F).

5. The method according to claim 1, wherein at least one of the following steps is associated with step D):

I) displaying an optical countdown corresponding to the required compaction time (t);

II) displaying a total remaining time corresponding to the remaining required compaction time (t);

III) displaying a traffic light function depending on the required compaction time (t);

IV) emitting an acoustic signal as soon as the required compaction time (t) has expired;

V) stopping a vibration function of the attachable compactor; and

VI) stopping the currently required compaction time (t)/compaction rate corresponding to the contact pressure in response to a flashing, light-emitting element.

6. The method according to claim 1, wherein a reset function is provided so that, if pressure is taken off the attachable compactor or in particular if the attachable compactor is raised off the ground, steps A) to D) are automatically executed.

7. The method according to claim 1, wherein the measured variable correlating with the contact force (F) is one of the following:

1) hydraulic pressure of an actuating cylinder of an excavator arm;

2) electrical voltage signal of a sensor element, such as a displacement measuring sensor;

3) relief pressure or relief force of at least one driving device of the excavator; and 4) a path signal on an elastic connecting element between a base plate and a superstructure of the attachable compactor.

8. A compactor for executing the method according claim 1, comprising:

a) a base plate;

b) a motor-driven vibration generator, with which the base plate can be vibrated;

c) a superstructure connected to the base plate; and d) a coupling device configured to engage an excavator arm;

characterized in that a sensor device is provided, which is configured in such a way that, with said sensor device, a contact force (F) of the excavator arm on the compactor or of the compactor on the ground or of a measured variable correlating with the contact force (F) can be determined, in that a control unit is provided that determines the required compaction time (t) based on the determined contact force (F) or on the basis of the measured variable correlating with the contact force (F), and in that a signal device is provided that is configured in such a way it displays at least the required compaction time (t).

9. The compactor according to claim 8, wherein the sensor device comprises at least one of the following features:

a) a sensor element configured as a force sensor, in particular as one of a resistive force transducer, a piezo force transducer or a wire strain gauge;

b) the sensor device is arranged on the superstructure;

c) the sensor device is integrated in the coupling device;

d) the sensor device is connected to the control unit via a signal line; and e) the sensor device detects the deformation of an elastic damping element between the superstructure and the base plate.

10. The compactor according to claim 8, wherein the control unit comprises a memory unit, wherein at least one value table, one index field or a plurality of reference curves is stored in a memory unit, which includes the achieved degree of compaction (Q) or a corresponding measurement value for the contact force (F) or a corresponding measurement value depending on the compaction time (t).

11. The compactor according to claim 8, wherein the signal device comprises at least one of the following features:

a) the signal device comprises an optical display device, in particular an indicator light, an indicator traffic light or an indication of the time;

b) the signal device comprises an acoustic display device with at least one speaker;

c) the signal device is arranged on the superstructure of the compactor, in particular oriented to the inside of the compactor; and d) the signal device comprises a control element controlled by the control unit, with which the vibration operation of the vibration generator can be interrupted.

12. The compactor according to claim 8, wherein the compactor comprises a converter for converting vibrations into electric energy, wherein the sensor device and/or the control unit and/or the signal device are supplied with the electrical energy obtained.

13. An excavator, comprising:

a drive motor, an operating platform, driving devices, an excavator arm and an attachable compactor, attached to the excavator arm via a coupling device, with a base plate and a superstructure, wherein the excavator is configured to carry out the method according to claim 1.

14. The excavator according to claim 13, wherein the signaling device is arranged in the operating platform of the excavator.

15. The excavator according to claim 13, wherein an electrical connection line is provided, connected with the electrical system of the excavator, that supplies electrical energy to the sensor device and/or the control unit (18) and/or the signaling device.

16. An excavator, comprising:

a drive motor, an operating platform, driving devices, an excavator arm and an attachable compactor, attached to the excavator arm via a coupling device, wherein the attachable compactor comprises:

a) a base plate;

b) a motor-driven vibration generator, with which the base plate can be vibrated;

c) a superstructure connected to the base plate; and d) a coupling device configured to engage the excavator arm;

characterized in that a sensor device is provided, which is configured in such a way that, with said sensor device, a contact force (F) of the excavator arm on the compactor or of the compactor on the ground or of a measured variable correlating with the contact force (F) can be determined, in that a control unit is provided that determines the required compaction time (t) based on the determined contact force (F) or on the basis of the measured variable correlating with the contact force (F), and in that a signal device is provided that is configured in such a way it displays at least the required compaction time (t).

* * * * *